US005184560A

United States Patent [19]

Asano

[11] Patent Number: 5,184,560

[45] Date of Patent: Feb. 9, 1993

[54] AUTOMATIC SEWING MACHINE CAPABLE OF EXECUTING STITCH BACK OPERATION

[75] Inventor: Fumiaki Asano, Nagoya, Japan

[73] Assignee: Brother Kogyo Kabushiki Kaisha, Nagoya, Japan

[21] Appl. No.: 852,287

[22] Filed: Mar. 16, 1992

[30] Foreign Application Priority Data

May 31, 1991 [JP] Japan ..... 3-157814

[51] Int. Cl.[5] ..... D05B 21/00; D05B 69/18; D05B 69/36

[52] U.S. Cl. ..... 112/121.12; 112/273; 112/316

[58] Field of Search ..... 112/273, 275, 278, 316, 112/317, 314, 315, 121.12, 103

[56] References Cited

U.S. PATENT DOCUMENTS 4,563,963 1/1986 Hanyu ..... 112/451 X 5,078,068 1/1992 Hager et al. ..... 112/273 X

FOREIGN PATENT DOCUMENTS 62-14886 1/1987 Japan ..... 112/273

*Primary Examiner*—Peter Nerbun

*Attorney, Agent, or Firm*—Oliff & Berridge

[57] ABSTRACT

An automatic sewing machine capable of executing a stitch back operation forms a nonfraying, aesthetically pleasing stitch in an embroidery pattern when resuming a stitching operation after thread breakage. The machine includes a movable needlebar holding a needle, a movable workpiece holder, storage for stitch data representing stitch positions, a control mechanism for controlling the needlebar and workpiece for executing a sewing operation based on the stitch data, a thread breakage detector, a stopping mechanism for stopping the sewing operation upon detection of thread breakage, a stitch back positioner for setting the stitch back position corresponding to the last complete stitch, a nonfraying stitch forming a positioner for setting the nonfraying stitch position, and a sewing operation resuming mechanism.

15 Claims, 7 Drawing Sheets

| ITEM | INSTRUCTIONS |
|---|---|
| S501 | READ STITCH DATA |
| S502 | STORE TOTAL STITCH NUMBER M |
| S503 | C←1 |
| S504 | SEWING STITCH POSITION NUMBERED C |
| S505 | THREAD BREAKAGE DETECTED? |
| S506 | C←C+1 |
| S507 | C>M |
| S508 | STOP SEWING OPERATION |
| S509 | S=0 |
| S510 | DISPLAY STITCH BACK MESSAGE |
| S511 | BACK KEY TURNED ON? |
| S512 | READ LAST STITCH DATA |
| S513 | MOVE EMBROIDERY FRAME |
| S514 | S=S+1 |
| S515 | START KEY TURNED ON? |
| S516 | C←C-S |
| S517 | DETERMINE NONFRAYING STITCH FORMING POSITION a |
| S518 | SEWING NONFRAYING STITCH FORMING POSITION c |

Fig.4B

| ITEM | INSTRUCTIONS |
|---|---|
| S501 | READ STITCH DATA |
| S502 | STORE TOTAL STITCH NUMBER M |
| S503 | C←1 |
| S504 | SEWING STITCH POSITION NUMBERED C |
| S505 | THREAD BREAKAGE DETECTED? |
| S506 | C←C+1 |
| S507 | C>M |
| S508 | STOP SEWING OPERATION |
| S509 | S=0 |
| S510 | DISPLAY STITCH BACK MESSAGE |
| S511 | BACK KEY TURNED ON? |
| S512 | READ LAST STITCH DATA |
| S513 | MOVE EMBROIDERY FRAME |
| S514 | S=S+1 |
| S515 | START KEY TURNED ON? |
| S516 | C←C-S |
| S517 | DETERMINE NONFRAYING STITCH FORMING POSITION α |
| S518 | SEWING NONFRAYING STITCH FORMING POSITION α |

AUTOMATIC SEWING MACHINE CAPABLE OF EXECUTING STITCH BACK OPERATION

BACKGROUND OF THE INVENTION

1. Field of the Invention

The present invention relates to an automatic sewing machine that operates according to stitch data to form a stitch pattern on a workpiece and, more specifically, to an automatic sewing machine capable of executing a stitch back operation when the sewing thread is broken.

2. Description of the Related Art

An embroidery machine, which belongs to one of the categories of automatic sewing machines, forms a stitch pattern on a workpiece held on an embroidery frame by moving the embroidery frame based on stitch data representing the coordinates of stitch positions in the stitch pattern.

An embroidery machine provided with a thread breakage detecting mechanism stops its sewing operation automatically when thread breakage is detected. Then, the thread is threaded normally on the embroidery machine, the embroidery frame is reversed according to the stitch data so that the last complete stitch formed on the workpiece coincides with the needle, and the embroidery machine is restarted to resume sewing operation. The operation for reversing the embroidery frame according to the stitch data so that the last complete stitch coincides with the needle is called a stitch back operation. Stitch back operation is disclosed in, for example, U.S. Pat. No. 4,413,574.

The embroidery machine capable of stitch back operation, however, has a disadvantage that a stitch is liable to fray when the first stitch to be formed after resuming sewing operation is a long one. If the embroidery frame is reversed by a stitch back operation beyond the last complete stitch until the first stitch to be formed after resuming sewing operation is a short one, a large area of the stitch pattern is double-stitched. The double-stitched area rises relative to the other single-stitched area of the stitch pattern, thereby spoiling the aesthetic quality of the stitch pattern.

SUMMARY OF THE INVENTION

An object of the present invention is to provide an automatic sewing machine capable of forming a stitch which is difficult to fray when a sewing operation is resumed.

Another object of the present invention is to provide an automatic sewing machine capable of forming stitches after resuming sewing operation without spoiling the aesthetic quality of a stitch pattern.

To achieve the above and other objects, the present invention provides an automatic sewing machine capable of executing stitch back operation, comprising: a needlebar reciprocably provided in a vertical direction and holding a needle at a lower end thereof; needlebar driving means for reciprocating the needlebar; workpiece holding means for holding a workpiece; workpiece moving means for moving the workpiece holding means relative to the needlebar in a plane perpendicular to the vertical direction; stitch data storage means for storing stitch data representing stitch positions at which the stitches of a stitch pattern are to be formed; control means for controlling the needlebar driving means and the workpiece moving means for executing a sewing operation based on the stitch data stored in the stitch data storage means to form the stitch pattern on the workpiece; thread breakage detecting means for detecting a breakage of a thread; stopping means for stopping the sewing operation of the control means upon a detection of the breakage of the thread by the thread breakage detecting means; stitch back position setting means for setting a stitch back position corresponding to a stitch position of the last complete stitch formed before the breakage of the thread is detected by the thread breakage detecting means; nonfraying stitch forming position setting means for setting a nonfraying stitch forming position with reference to the stitch back position set by the stitch back position setting means; and sewing operation resuming means for resuming the sewing operation executed by the control means based on the stitch back position set by the stitch back position setting means and the nonfraying stitch forming position set by the nonfraying stitch forming position setting means.

The automatic sewing machine thus constructed in accordance with the present invention operates according to the stitch data representing sewing positions on a stitch pattern and stored beforehand in the stitch data storage means to form the stitch pattern on a workpiece. Upon the detection of thread breakage by the thread breakage detecting means during sewing operation, the stopping means stops the sewing operation. The stitch back position setting means sets a stitch back position corresponding to a stitch position of the last complete stitch formed before the detection of thread breakage, and then the nonfraying stitch forming position setting means sets a nonfraying stitch forming position with reference to the stitch back position. After the automatic sewing machine has correctly been threaded, the sewing operation resuming means starts the automatic sewing machine for sewing operation, in which a nonfraying stitch is formed near the stitch back position.

As is apparent from the foregoing description, the automatic sewing machine of the present invention is capable of automatically forming a nonfraying stitch when resuming the sewing operation, and hence the stitches formed after resuming the sewing operation do not become loose. Furthermore, the stitch pattern can be formed with a satisfactory appearance without a large double-stitched area.

BRIEF DESCRIPTION OF THE DRAWINGS

Preferred embodiments of the present invention will be described in detail with reference to the following figures, wherein:

FIGS. 4A and 4B are a flow chart and a table, respectively, of a stitch back operation control program stored in a ROM included in the controller;

DETAILED DESCRIPTION OF THE PREFERRED EMBODIMENTS

The present invention will be described hereinafter as applied to an embroidery machine.

Figure 1:
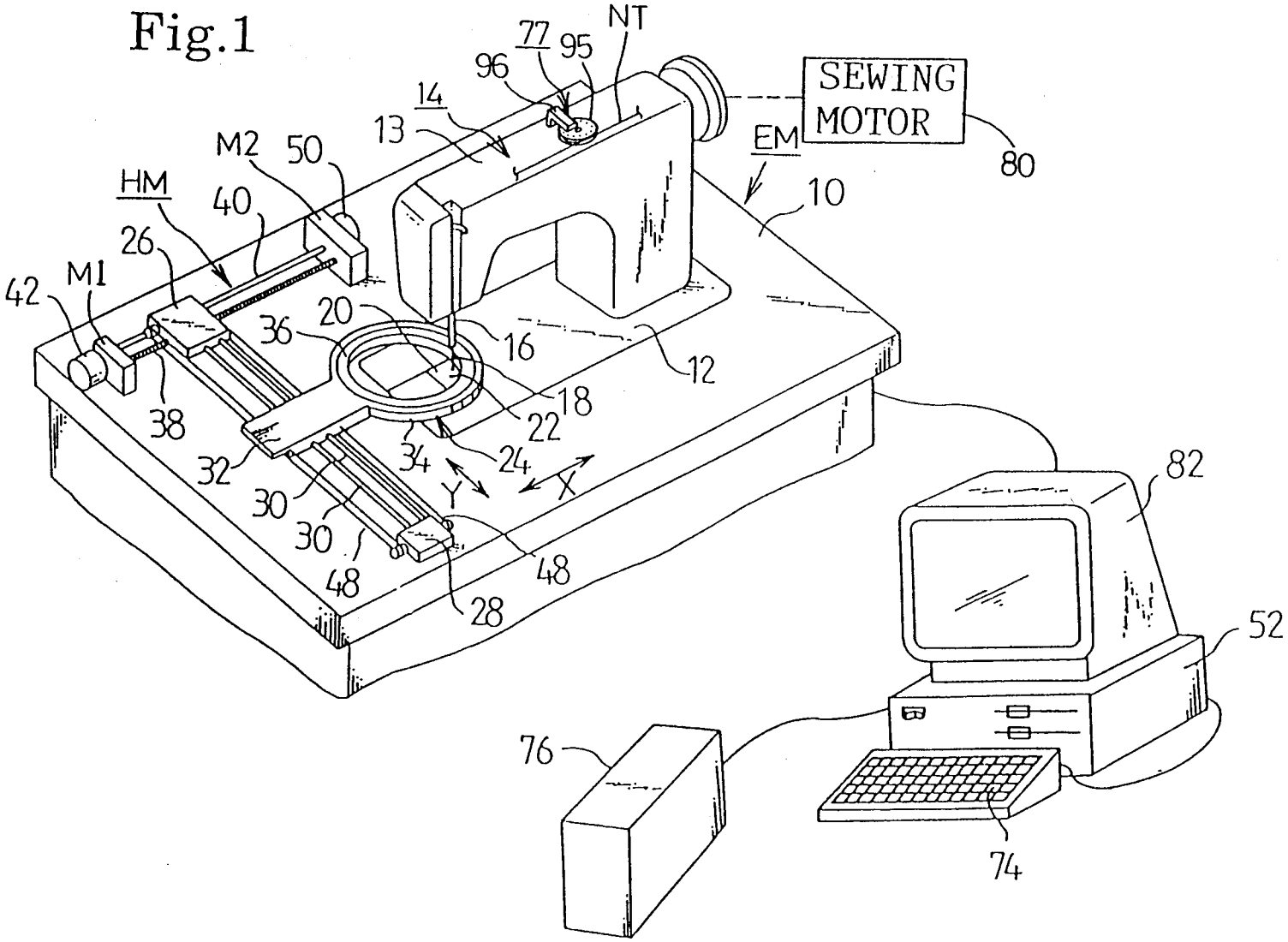
FIG. 1 is a perspective view of an embroidery machine according to the present invention and a controller for controlling the same.
Figure 2:
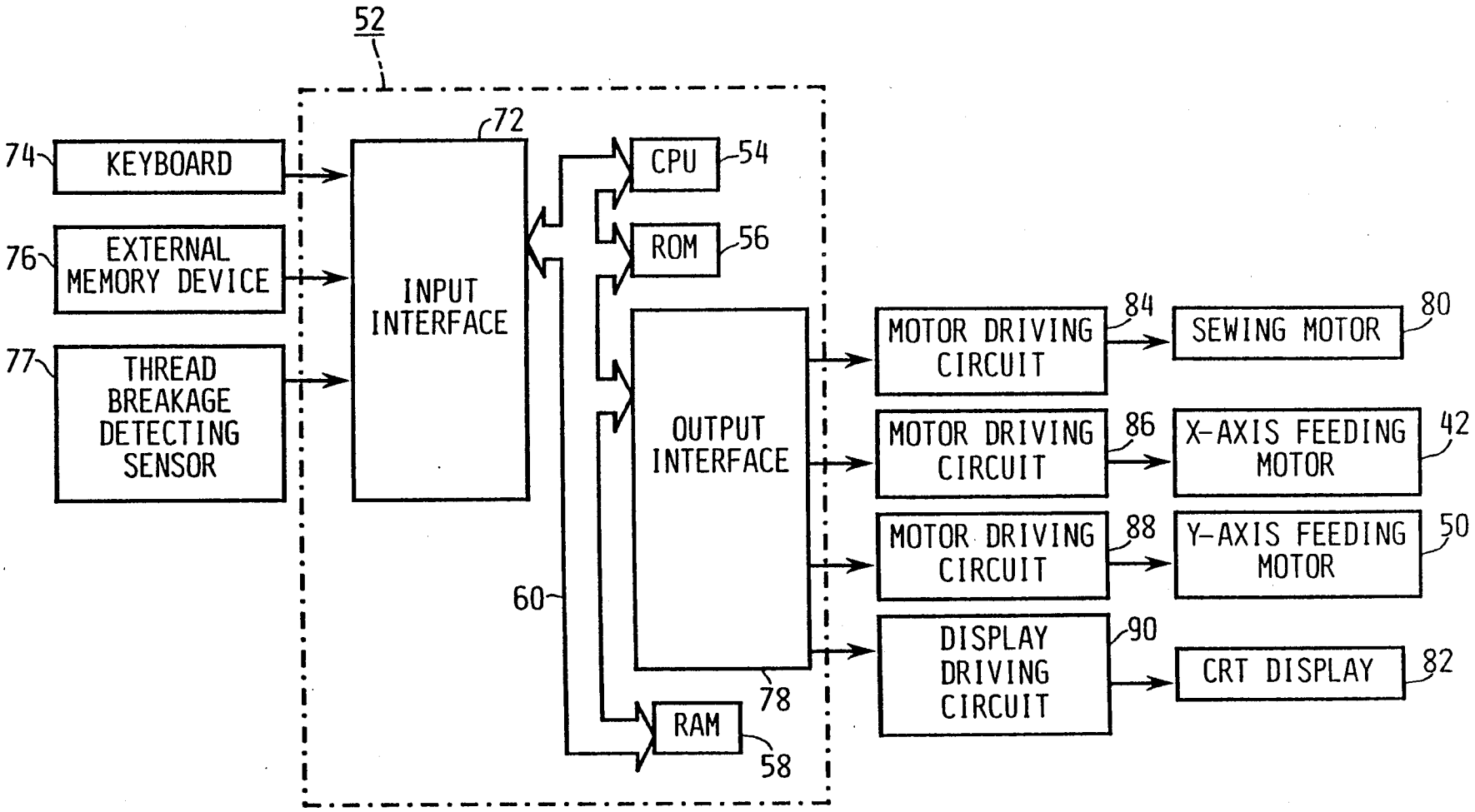
FIG. 2 is a block diagram of the electric systems of the embroidery machine and the controller shown in FIG. 1.

As shown in FIG. 1, an embroidery machine EM has a sewing unit 14 comprising a table 10, a bed 12, and an arm 13 having a head. A needlebar 16 holding a needle 18 on its lower end is supported for vertical reciprocation on the head of the arm 13. The needlebar 16 is driven for vertical reciprocation by a sewing motor 80 (FIG. 2). A throat plate 20 provided with a needle hole 22 is placed on the bed 12 so as to cover an opening formed in the bed 12. The needle 18 penetrates the throat plate 20 through the needle hole 22.

An embroidery frame 24 holding work fabric is supported on the table 10. The embroidery frame 24 has an annular outer hoop 34 and an annular inner hoop 36 detachably fitted in the outer member 34. The work fabric is held taut between the outer hoop 34 and the inner hoop 36.

An embroidery frame moving mechanism HM moves the embroidery frame 24 on the table 10 to locate stitch positions on the workpiece directly below the needle 18. The embroidery frame moving mechanism HM has a slide plate 32 formed integrally with the outer hoop 34 of the embroidery frame 24. The slide plate 32 is supported on guide bars 30, supported at their opposite ends on support blocks 26 and 28, so as to extend along a Y-axis extending in directions indicated by arrows Y. The slide plate 32 is guided for sliding along the guide bars 30. Motor bases M1 and M2 are provided fixedly on the table 10, and an X-axis feed motor 42 and a Y-axis feed motor 50 are mounted respectively on the motor bases M1 and M2. A screw rod 38 is journaled on the motor bases M1 and M2 so as to extend along an X-axis extending in directions indicated by arrows X perpendicular to the Y-axis. The screw rod 38 engages a threaded hole formed in the support block 26. The screw rod 38 is driven for rotation by the X-axis feed motor 42 to move the support block 26 along the X-axis together with the support block 28, the slide bars 30 and the embroidery frame 24.

A transmission shaft 40 is journaled on the motor bases M1 and M2 so as to extend along the X-axis, and is driven for rotation by the Y-axis feed motor 50. The Y-axis feed motor 50 rotates the transmission shaft 40 to turn endless wire belts 48 extended between the support blocks 26 and 28 and fastened to the slide plate 32. Accordingly, the embroidery frame 24 can be moved along the Y-axis through the transmission shaft 40, the endless wire belts 48 and the slide plate 26 by the Y-axis feed motor 50. Thus, the embroidery frame moving mechanism HM moves the embroidery frame 24 optionally on the table 10 in both X and Y directions relative to the needle 18 to locate stitch positions directly below the needle 18.

A known thread breakage detecting sensor 77 is provided on the upper surface of the arm 13. The thread breakage detecting sensor 77 comprises a rotary disk 95, and an optical sensor 96 for detecting the rotation of the rotary disk 95. A needle thread NT guided to the needle 18 is wound around the rotary disk 95. While the needle thread NT is fed to the needle 18 to form stitches on the work fabric, the rotary disk 95 rotates and the optical sensor 96 provides a rotation detection signal as long as the needle thread NT is being fed. Upon the occurrence of breakage of the needle thread NT, the optical sensor 96 stops generating the rotation detection signal.

A controller 52 is connected to the embroidery machine EM to control the same. A keyboard 74, an external memory device 76 and a CRT display 82 are connected to the controller 52.

Figure 3:
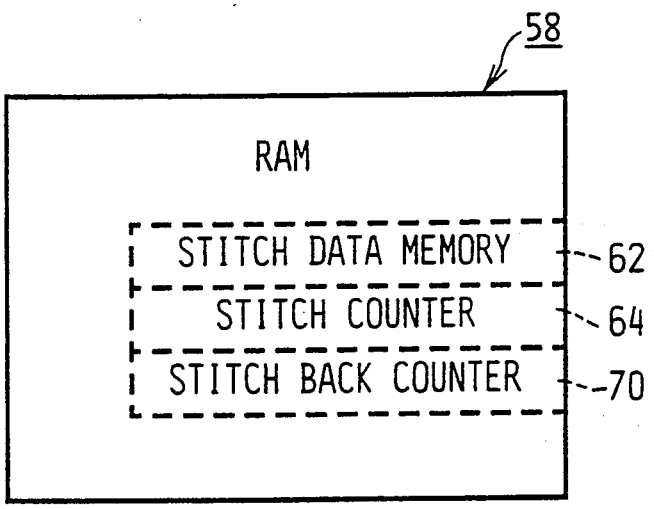
FIG. 3 is a view of assistance in explaining a memory area in a RAM included in the controller.

FIG. 2 is a block diagram of a control system for controlling the embroidery machine EM. The controller 52 comprises, as a principal component, a computer comprising a CPU 54, a ROM 56, a RAM 58 and a bus 60. As shown in FIG. 3, the RAM 58 has a stitch data memory 62, a stitch counter 64 and a stitch back counter 70 in addition to a working area. Stitch data representing a stitch pattern to be formed on the work fabric is stored in order of sewing sequence. The stitch data are the coordinates of stitch positions on the stitch pattern. The stitch counter 64 stores the number of stitches, which will be described below. The stitch back counter 70 stores the number of back stitches, which will also be described below. A stitch back operation control program shown in FIGS. 4A and 4B and a length for a nonfraying stitch, for example, 0.3 mm, are stored beforehand in the ROM 56. A nonfraying stitch is formed to prevent the fraying of stitches.

The keyboard 74, the external memory device 76 and the thread breakage detecting sensor 77 are connected through an input interface 72 of the controller 52 to the bus 60. Data representing a stitch pattern to be formed on the work fabric, intervals between pattern elements of the stitch pattern or thread density are entered by operating the keyboard 74. The keyboard 74 is provided with character keys, numerical keys, symbol keys, a start key for starting the embroidery machine EM, and a stitch back key, called a back key, for giving a stitch back command to the embroidery machine EM to direct the embroidery machine EM for stitch back operation. Motor driving circuits 84, 86 and 88 for driving the sewing motor 80, the X-axis feed motor 42 and the Y-axis feed motor 50, and a display driving circuit 90 for driving the CRT display 82 are connected through an output interface 78 of the controller 52 to the bus 60. The stitch pattern represented by the stitch data is displayed on the CRT display 82.

A stitch back procedure to be executed when the needle thread NT is broken will be described with reference to the flow chart and table shown in FIGS. 4A and 4B. The CPU 54 carries out the stitch back procedure according to the stitch back operation control program stored in the ROM 56. First the keyboard 74 is operated to select a desired stitch pattern among those stored in the external memory device 76, and then the start key is operated. Then, the CPU 54 reads the stitch data of the selected stitch pattern from the external memory device 76 and stores the same in the stitch data memory 62 of the RAM 50 in step S501. The total number M of stitches, namely, the total number of stitch positions, specified by the stitch data stored in the stitch data memory 62 is stored in the RAM 58 in step S502. The count C of the stitch counter 64 indicating the number of the next stitch is set for 1 in step S503. Then, a stitch of the number corresponding to the count C counted by the stitch counter 64, namely, the first stitch, is formed based on the stitch data stored in the stitch data memory 62 in step S504. During the sewing operation performed based on the stitch data, command signals are given to the motor driving circuits 84, 86 and 88 respectively for driving the sewing motor 80, the X-axis feed motor 42 and the Y-axis feed motor 50 to reciprocate the needlebar 16 once after locating the embroidery frame 24 at a stitch position specified by the stitch data.

A query is made in step S505 to see if the needle thread NT is broken, namely, to see if the rotation detection signal provided by the optical sensor 96 of the thread breakage detecting sensor 77 is interrupted. If the response in step S505 is negative, the count C of the stitch counter 64 is incremented by 1 in step S506 to increase the count C to 2. Then, in step S507, a query is made to see if the count C of the stitch counter 64 is greater than the total number M of stitches. If the response in step S507 is affirmative, the procedure is ended. If the response in step S507 is negative, the program returns to step S504 to execute the same procedure for the second stitch. A loop including steps S504 to S507 is repeated to form all the stitches sequentially according to the stitch data stored in the stitch data memory 62 until the response in step S507 becomes affirmative.

Figure 5A:
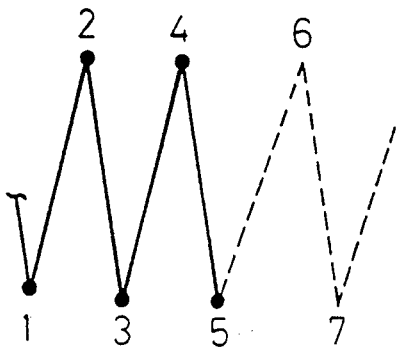
FIGS. 5A and 5B are diagrammatic views of stitches formed by the sewing operation controlled according to the stitch back operation control program.

If the needle thread NT is broken during the repetition of the loop including steps S504 to S507, the rotation detection signal provided by the thread breakage detecting sensor 77 is interrupted, and hence the response in step S505 is affirmative. Then, the sewing motor 80 is stopped automatically in step S508. Since the thread breakage detecting sensor 77, in general, is unable to respond instantaneously to the breakage of the needle thread NT, the sewing operation is stopped after the embroidery frame 24 has been moved for several incomplete stitches from the occurrence of the breakage of the needle thread NT. For example, as shown in FIG. 5A, the sewing operation will be stopped after the embroidery frame 24 has been moved to a stitch position corresponding to the seventh stitch if the needle thread NT is broken after the fifth stitch has been formed. Accordingly, the embroidery frame 24 must be reversed by stitch back operation to a stitch position corresponding to the last complete stitch, i.e., the fifth stitch in FIG. 5A, to stitch the missing stitches, i.e., the sixth and seventh stitches. The stitch position at which the sewing operation based on the stitch data is to be resumed will be referred to as the "stitch back position".

In step S509, the count S of the stitch back counter 70 is set for 1, and then a message prompting the operator to execute the stitch back operation is displayed on the CRT display 82 in step S510. When the stitch back key of the keyboard 74 is depressed, the keyboard 74 provides a stitch back signal, and an affirmative decision is made in step S511. In step S512, the stitch data of the stitch preceding the stitch corresponding to the current stitch position of the embroidery frame 24 is read from the stitch data memory 62. Then, in step S513, the embroidery frame 24 is reversed to the stitch position specified by the stitch data. In step S514, the count S of the stitch back counter 70 is incremented by 1, and then the program returns to step S511. A loop including steps S511 to S514 is repeated as long as the stitch back key is depressed. Thus, the stitch back key is kept depressed until the embroidery frame 24 is reversed to the stitch back position.

When the stitch back key is released, a negative decision is made in step S511 and step S515 is executed to see if the start key is depressed. When the start key of the keyboard 74 is depressed after the needle thread NT has been threaded correctly on the embroidery machine EM, the keyboard 74 provides a start signal, and an affirmative decision is made in step S515. Then, in step S516, the count S of the stitch back counter 70 is subtracted from the count C of the stitch counter 64. Therefore, the stitch position corresponding to the count C of the stitch counter 64 is the stitch back position. Suppose that the needle thread NT is broken after the fifth stitch has been formed, and the sewing operation is stopped after the count C of the stitch counter 64 has increased to seven, namely, after the embroidery frame 24 has been moved to the stitch position corresponding to the seventh stitch, without forming stitches as shown in FIG. 5A. The embroidery frame 24 needs to be reversed to the stitch position corresponding to the fifth stitch; that is, the stitch position corresponding to the fifth stitch is the stitch back position. Accordingly, the count C of the stitch counter after subtraction in step S516 is 5 ($7-2=5$). In step S517, a nonfraying stitch forming position $\alpha$ near the stitch position corresponding to the Cth stitch indicated by the count C of the stitch counter 64 is determined through calculation.

Figure 5B:
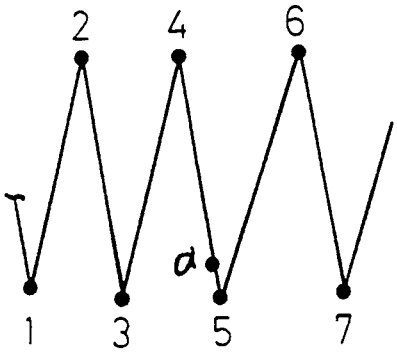
Figure 7:
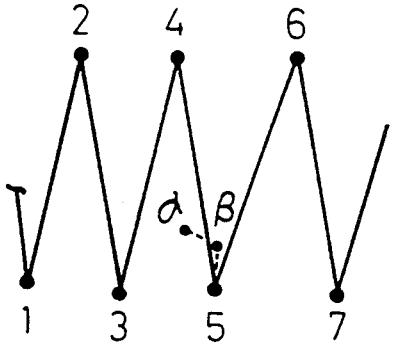
FIG. 7 is a diagrammatic view of stitches formed by a modification of the embroidery machine.

The nonfraying stitch forming position $\alpha$ is at a predetermined distance, for example, 0.3 mm, stored in the ROM 56 on a segment line between the stitch position corresponding to the last complete stitch, i.e., the Cth stitch, and a stitch position corresponding to the $(C-1)$th stitch. In the case shown in FIG. 5A, the nonfraying stitch forming position $\alpha$ is at a distance of 0.3 mm from the stitch position corresponding to the fifth stitch toward the stitch position corresponding to the fourth stitch as shown in FIG. 5B. Although the distance between the last complete stitch and the nonfraying stitch is dependent on the type and thickness of the needle thread NT, the distance of 0:3 mm is sufficient to prevent fraying. In step S518, the nonfraying stitch forming operation is executed. Namely, the embroidery frame 24 is reversed to the nonfraying stitch forming position and a nonfraying stitch is formed and then the program returns to step S504. Then, sewing operation based on the stitch data is resumed at the stitch position corresponding to the Cth stitch (the fifth stitch, in the case of FIG. 5A) to form the stitch pattern.

Thus, the embroidery machine EM in this embodiment forms a nonfraying stitch automatically at a stitch position before a stitch back position at which sewing operation based on the stitch data is to be resumed. Accordingly, the first stitch after the restart of sewing operation, even if it is a long stitch, can completely be formed and the first stitch is not subject to fraying. Since the length of the nonfraying stitch is on the order of 0.3 mm, the nonfraying stitch is inconspicuous and does not spoil the aesthetic quality of the stitch pattern.

The present invention is not limited in its application to the embodiment described above and many changes and variations are possible therein. In the embodiment described above, the embroidery frame 24 is reversed to the stitch back position corresponding to the last complete stitch among those formed before the breakage of the needle thread NT by continuously depressing the stitch back key; that is, the stitch back position is determined by the operator. However, it is possible to determine the stitch back position automatically through calculation.

Figure 4A:
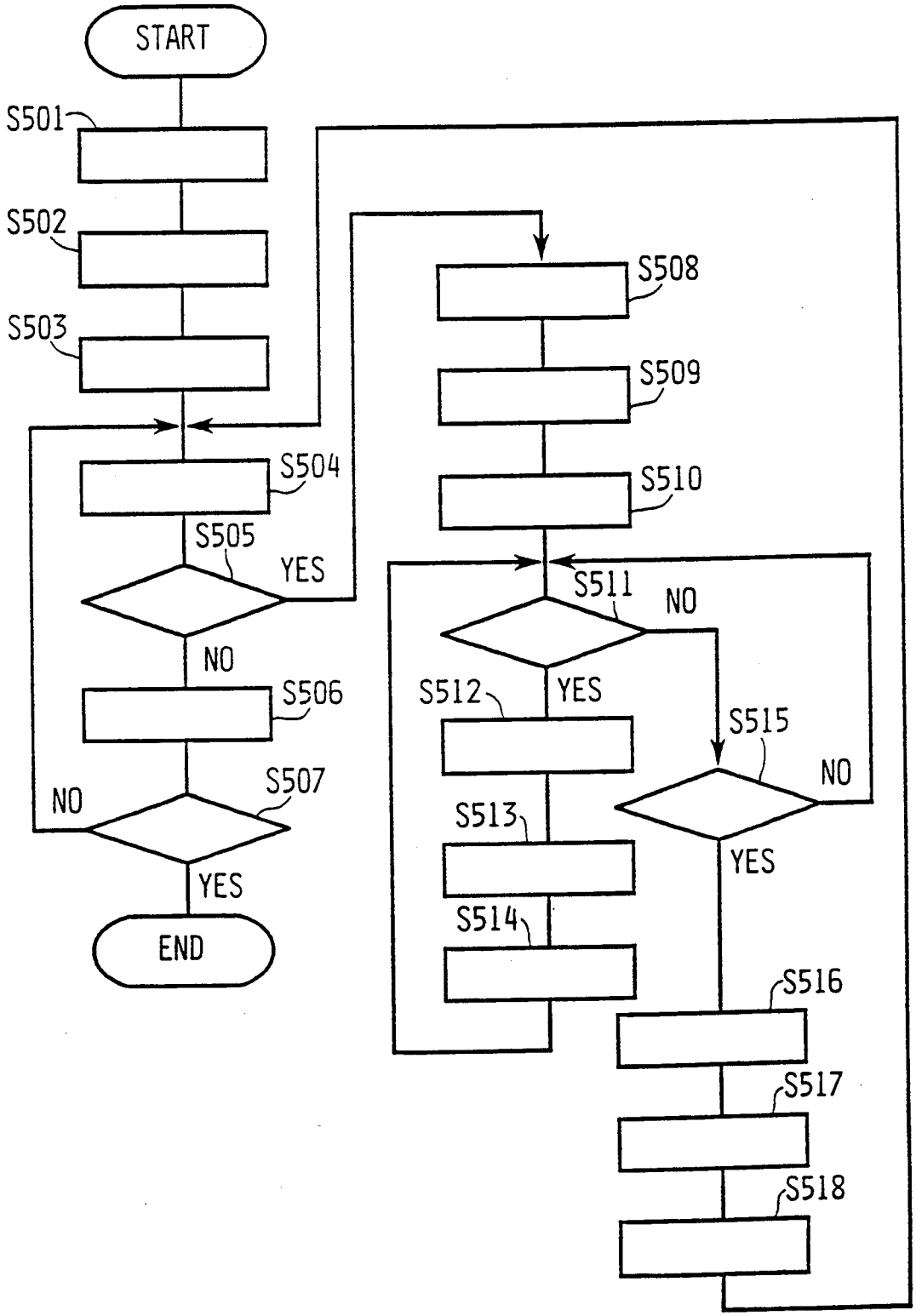
Figure 6:
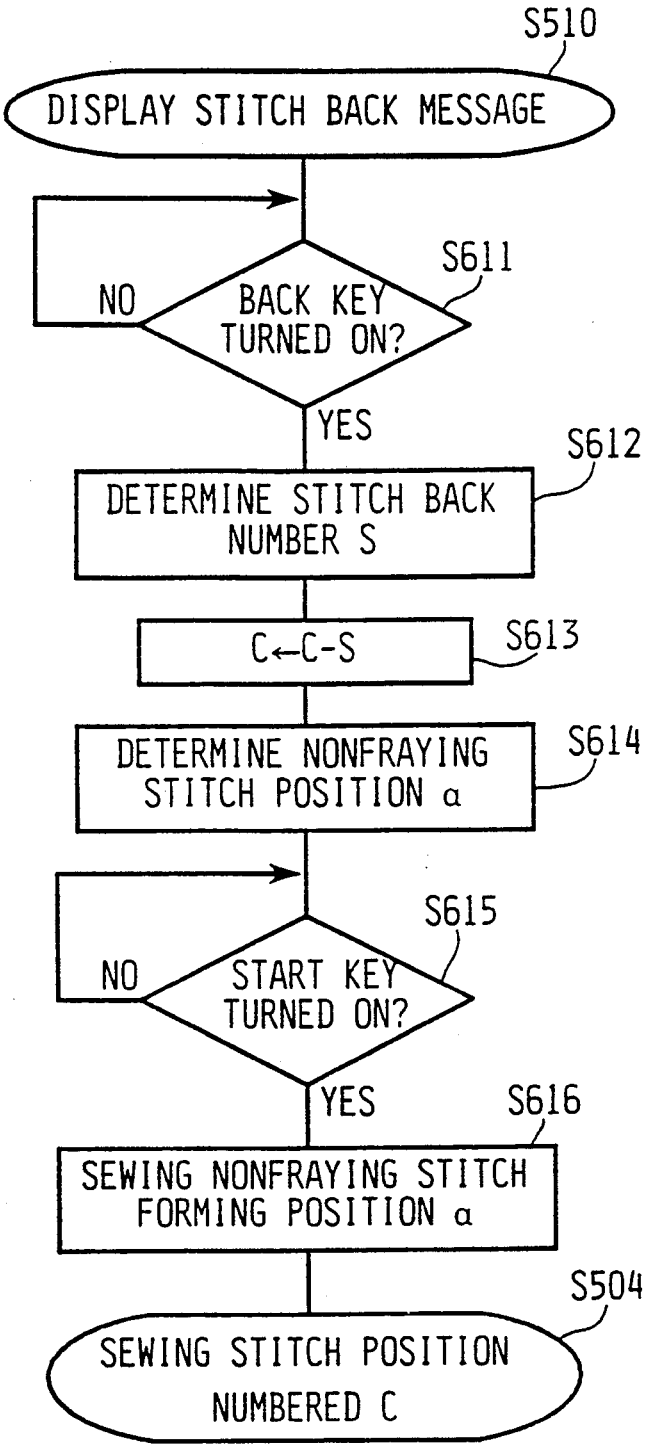
FIG. 6 is a flow chart of a modification of the stitch back operation control program of FIGS. 4A and 4B.

The automatic determination of the stitch back position can be achieved by substituting steps S511 to S518 of the control program shown in FIGS. 4A and 4B by steps S611 to S616 shown in FIG. 6. When it is decided in step S611 that the stitch back key is depressed, step S612 is executed. In step S612, the number of cycles of reciprocation of the needlebar 16 between the detection of the breakage of the needle thread NT in step S505 and the stop of the main motor, and the number of cycles of reciprocation of the needlebar 16 in a delay time taken by the thread breakage detecting sensor 77 after the breakage of the needle thread NT are added to determine or obtain the stitch back number S, namely, the number of stitches by which the embroidery frame 24 must be reversed. The stitch back number S is subtracted from the count C of the stitch counter 64 in step S613. The count C of the stitch counter 64 after subtraction corresponds to the stitch back position. Thus, the stitch back position corresponding to the Cth stitch from which sewing operation is to be resumed can automatically be determined by automatically determining the stitch back number S. Then, the nonfraying stitch forming position $\alpha$ is determined through calculation in step S614, which is the same as step S517. When the start key is depressed after threading the needle thread NT on the embroidery machine EM, an affirmative decision is made in step S615, and then the embroidery frame 24 is reversed directly to the nonfraying stitch forming position $\alpha$ and a nonfraying stitch is formed in step S616. Then, the program returns to step S504 of the control program shown in FIGS. 4A and 4B to resume sewing operation at a stitch position corresponding to the Cth stitch.

Although only one nonfraying stitch is formed in the embodiment described above, two or more nonfraying stitches may be formed to further ensure the prevention of fraying. In forming two nonfraying stitches, it is desirable to form the two nonfraying stitches respectively at two nonfraying stitch forming positions $\alpha$ and $\beta$ determined so that a line passing the nonfraying stitch forming positions $\alpha$ and $\beta$ intersects a line connecting the Cth (fifth) stitch, i.e., the last complete stitch, and the $(C-1)$th (fourth) stitch, because the fraying of the last complete stitch, i.e., the Cth stitch, can surely be prevented when the stitches are formed in order of a nonfraying stitch at the nonfraying stitch forming position a nonfraying stitch at the nonfraying stitch forming position $\beta$ and the fifth stitch.

The embroidery machine EM may be provided either internally or externally with the controller 52.

What is claimed is:

1. An automatic sewing machine capable of executing a stitch back operation, comprising:

a needlebar reciprocably provided in a vertical direction and holding a needle at a lower end thereof;

needlebar driving means for reciprocating said needlebar;

workpiece holding means for holding a workpiece;

workpiece moving means for moving said workpiece holing means relative to said needlebar in a plane perpendicular to the vertical direction;

stitch data storing means for storing stitch data representing stitch positions at which stitches of a stitch pattern are to be formed;

control means for controlling said needlebar driving means and said workpiece moving means for executing a sewing operation based on the stitch data stored in said stitch data storing means to form the stitch pattern on the workpiece;

thread breakage detecting means for detecting a breakage of a thread;

stopping means for stopping the sewing operation of said control means upon a detection of the breakage of the thread by said thread breakage detecting means;

stitch back position setting means for setting a stitch back position corresponding to a stitch position of the last complete stitch formed before the breakage of the thread is detected by said thread breakage detecting means;

nonfraying stitch forming position setting means for setting a nonfraying stitch forming position at a distance from the stitch back position set by said stitch back position setting means;

nonfraying stitch forming means for executing a nonfraying stitch forming operation at the nonfraying stitch forming position set by said nonfraying stitch forming position setting means by controlling said needlebar driving means and said workpiece moving means; and sewing operation resuming means for resuming the sewing operation executed by said control means at the stitch back position set by said stitch back position setting means.

2. The automatic sewing machine according to claim 1, further comprising:

nonfraying stitch length storage means for storing a length of the nonfraying stitch, wherein said nonfraying stitch forming position setting means sets the nonfraying stitch forming position at a position spaced from the stitch back position by the length stored in said nonfraying stitch length storage means.

3. The automatic sewing machine according to claim 1, wherein the control means includes a stitch data memory, a stitch counter for counting the stitch position and a stitch back counter for counting back to the stitch back position.

4. The automatic sewing machine according to claim 1, wherein the stitch back position setting means is a key operable by an operator.

5. The automatic sewing machine according to claim 1, wherein the stitch back position setting means includes means for automatically calculating the stitch back position.

6. The automatic sewing machine according to claim 1, wherein the nonfraying stitch forming position setting means sets two nonfraying stitch forming positions with reference to the stitch back position set by said stitch back position setting means.

7. The automatic sewing machine according to claim 6, wherein a stitch formed between the two non-fraying stitch forming positions crosses the last complete stitch.

8. The automatic sewing machine according to claim 1, wherein the nonfraying stitch forming position setting means sets the nonfraying stitch forming position coextensive and overlapping with the last complete stitch.

9. An automatic sewing machine comprising:

a stitching device for forming a stitch pattern formed of thread stitches having at least a first length on a workpiece;

thread breakage detecting means for detecting thread breakage and emitting a signal;

interrupting means for temporarily stopping the stitching device in response to the signal emitted by the thread breakage detecting means;

stitch back operation means for executing a stitch back operation for restarting the stitching device beginning at the last complete stitch; and nonfraying stitch means for setting a nonfraying stitch length which is less than the first stitch length and for forming a nonfraying stitch spaced from the last complete stitch by the nonfraying stitch length.

10. The automatic sewing machine according to claim 9, wherein the stitch back operation means includes a stitch back counter for counting back to the last complete stitch.

11. The automatic sewing machine according to claim 9, wherein the nonfraying stitch means includes means for forming a plurality of nonfraying stitches.

12. The automatic sewing machine according to claim 11, wherein said means for forming a plurality of nonfraying stitches forms at least one stitch which crosses the last complete stitch.

13. The automatic sewing machine according to claim 9, wherein said nonfraying stitch means forms a nonfraying stitch coextensive and overlapping with the last complete stitch.

14. The automatic sewing machine according to claim 9, wherein the stitch back operation means includes key operable by an operator.

15. The automatic sewing machine according to claim 9, wherein the stitch back operation means is automatically operated.

* * * * *